United States Patent [19]

Ivany

[11] 4,167,840

[45] Sep. 18, 1979

[54] REINFORCED MASONRY WALL CONSTRUCTION

[76] Inventor: George R. Ivany, 3871 W. Valley Dr., Fairview Park, Ohio 44126

[21] Appl. No.: 925,974

[22] Filed: Jul. 19, 1978

[51] Int. Cl.[2] ..... E04B 1/16; E04B 2/26

[52] U.S. Cl. ..... 52/438; 52/259; 52/439; 52/565

[58] Field of Search ..... 52/438, 439, 100, 259, 52/566, 561, 565, 426, 405, 421

[56] References Cited

U.S. PATENT DOCUMENTS

| | | | |
|---|---|---|---|
| 2,239,930 | 4/1941 | Peebles | 52/439 X |
| 2,326,708 | 8/1943 | Wanner | 52/438 X |
| 3,222,830 | 12/1965 | Ivany | 52/438 X |
| 3,717,967 | 2/1973 | Wood | 52/259 |
| 3,788,020 | 1/1974 | Gregori | 52/426 X |
| 4,091,587 | 5/1978 | Depka | 52/561 X |

*Primary Examiner*—H. Karl Bell
*Attorney, Agent, or Firm*—Albert L. Ely, Jr.

[57] ABSTRACT

A hollow building-block-type module for a wall construction that utilizes a plurality of such modules laid up with mortared joints in staggered courses and with horizontal and vertical reinforcing bars embedded in concrete poured into the spaces or voids within the hollow blocks. The module comprises parallel side walls joined by vertical webs to define an integral void between adjacent webs of the module and voids between adjacent webs of abutting modules. The voids in each course are vertically aligned in stacks with voids of other courses and the webs are provided with notches for locating the horizontal reinforcing bars away from an adjacent side wall. The module also has lips projecting inwardly from the side walls defining an integral void so that a vertical rod inserted in a stack of voids between a side wall and the horizontal reinforcing bars is also spaced away from the interior surface of the respective side walls of the vertically aligned voids. Further, at least some of the lips have a centrally located, inwardly projecting divider element with a greater inward extension than the lip itself so as to position a vertical reinforcing bar entirely on one side of the vertically aligned divider elements of a vertical stack of voids. The divider element restricts undesired inclination or vertical misalignment of the respective vertical reinforcing bar.

12 Claims, 3 Drawing Figures

REINFORCED MASONRY WALL CONSTRUCTION

BACKGROUND OF THE INVENTION

This invention relates to masonry wall constructions of the type utilizing hollow concrete or concrete-cinder blocks laid up with mortared joints in staggered courses and reinforced with steel reinforcing bars. More particularly, the invention relates to the positioning of the horizontal and vertical reinforcing bars in the voids within the hollow blocks prior to filling the voids with concrete, and especially to the construction and shape of the internal portions of the blocks that define the voids into which vertical reinforcing bars are inserted.

In modern building construction, masonry walls are commonly formed of hollow concrete or concrete-cinder blocks laid up with mortared joints staggered in successive courses. Horizontal reinforcing bars are embedded in successive courses, and vertical reinforcing bars are inserted in the vertically extended spaces formed by the vertically aligned voids of successive courses. The voids are subsequently filled with poured concrete that is rodded, puddled, or otherwise settled in place to provide a vertically and horizontally reinforced concrete masonry wall.

This general form of reinforcement is shown in my U.S. Pat. Nos. 3,222,830 and 3,717,967. In the masonry wall construction of my U.S. Pat. No. 3,222,830, the blocks are provided with an inwardly projecting lip that extends into its respective integral void away from the side wall of the block. The lips serve to space the vertical reinforcing bars from the interior side wall of a block and against a horizontal reinforcing bar to permit the concrete that is poured into the voids to completely surround and embed the vertical bar and thereby make a better use of the vertical bars as reinforcements of their respective side walls.

In actual practice, however, the final pouring can, and often does, haphazardly dislodge some of the vertical reinforcing bars from their intended vertical positions. Some degree of shifting of a reinforcing bar from a truly vertical position is tolerable so long as the bar remains fully embedded in the poured concrete. Heretofore, however, when a vertical bar intended to be adjacent one side wall shifts with respect to another unshifted bar adjacent the other side wall so that the pair of opposite bars are in substantial transverse alignment rather than staggered, the resultant haphazard arrangement indicated to a supervising architect or building inspector that one of the bars was insufficiently embedded and, consequently, approval would be withheld.

One approach toward correcting this problem is disclosed in the aforementioned U.S. Pat. No. 3,717,830 wherein the ends of the side walls of the blocks are provided with inturned vertical end flanges so that the flanges of adjacent blocks abut to form an inward projection whereby alternate courses in a vertical stack of voids define a vertical projection intermediate the corners of the side walls to confine the vertical reinforcing bars to restricted portions of the stack of voids. Such end flanges, however, permit a vertical reinforcing bar to rest directly against the end flanges, themselves, or the intermediate webs as well as against the adjacent side walls of the block, or, in other words, in the corners formed by the intersections of the adjacent side walls with the intermediate webs and/or end flanges. This restricts the flow of concrete around the vertical reinforcing bars located in that position and prevents proper embedding of the bars in the poured concrete. As a result, the desired reinforcement in the resulting masonry wall structure is not achieved.

The molded module construction of the present invention, however, solves the problem indicated above and affords other features and advantages heretofore not obtainable.

SUMMARY OF THE INVENTION

It is among the objects of the invention to improve the reinforcement of hollow-concrete-block masonry walls of the type that utilize vertical reinforcing bars embedded in poured concrete within the blocks. Another object is to achieve improved positioning of vertical reinforcing bars in reinforced masonry walls of the type described prior to and during the pouring of concrete into the vertical stacks of voids into which the vertical reinforcing bars are inserted.

These and other objects and advantages are achieved with the improved masonry wall construction of the invention, the wall being generally formed of primary, hollow building-block-type molded modules laid up with mortared joints in courses and with horizontal and vertical reinforcing bars embedded therein. The modules comprise side walls joined by vertical webs spaced from respective module ends to define an integral void between adjacent webs and voids between adjacent webs of abutting modules. The voids in each course are vertically aligned in stacks with voids of other courses and the webs define horizontally aligned notches for receiving horizontal reinforcing bars. Primary modules have a lip projecting inwardly from the inner faces of at least one side wall so that a vertical reinforcing bar inserted in a stack of aligned voids through a plurality of courses is positioned between vertically aligned horizontal reinforcing bars and the lips on an adjacent side of the stack of voids.

In accordance with the improvement of the invention, there is provided an inwardly projecting divider element formed on an interior side wall of the module, most advantageously, integral with the respective lip. The divider element is intermediate the webs that define the respective void and serves to define at least on one side thereof, a rod-receiving space in the respective stack of voids. This serves to position a vertical reinforcing bar on one side of the vertically aligned divider elements and between the vertically aligned lip portions on the respective sides of the divider and the adjacent vertically aligned horizontal reinforcing bars.

Thus, the divider elements limit tilting or angular inclination of the respective vertical reinforcing bar and at the same time permit the flow of poured concrete around the vertical reinforcing bar to assure that it is properly embedded in order to achieve optimum strength in the resulting masonry wall.

DESCRIPTION OF THE PREFERRED EMBODIMENTS

Figure 1:
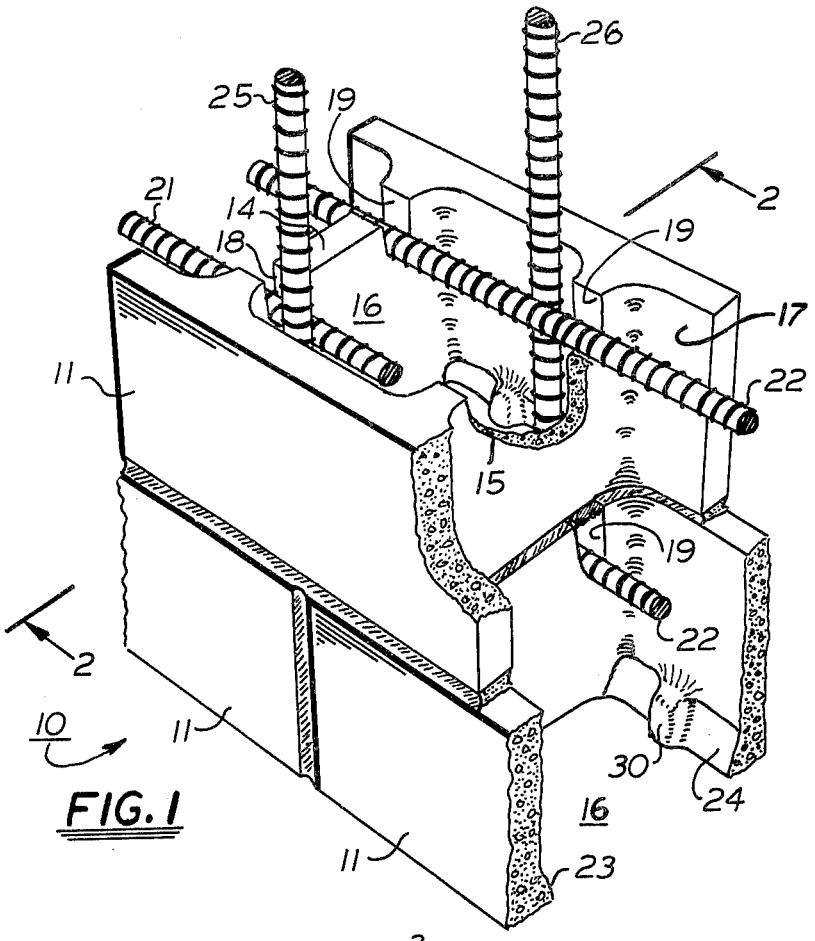
FIG. 1 is a fragmentary perspective view of a portion of a masonry wall construction utilizing hollow concrete or concrete-cinder blocks embodying the present invention and laid up with mortared joints and reinforced with steel reinforcing bars, with parts broken away and shown in section for the purpose of illustration.

Referring more particularly to the drawings, FIG. 1 shows a portion of a masonry wall 10 constructed of hollow concrete or concrete-cinder blocks 11 made according to this invention. The blocks or modules 11 are laid up with mortared joints in staggered courses and reinforced with steel reinforcing bars. The primary hollow blocks or modules 11 are produced of the usual materials by well-known methods of forming blocks of this general type, for example, by molded concrete or concrete-cinder block compositions and techniques. The modules 11 have two parallel side walls 12 and 13 joined by two parallel vertical webs 14 and 15 spaced inwardly equally from the ends of the block a distance roughly half the spacing between the webs to define therebetween an integral cavity or void 16.

The spacing of the center planes of the webs 14 and 15 from the adjacent ends of a block 11 is slightly less than half of the spacing between the planes so that the ends of a block open into substantially half-voids 17. Thus, when two blocks 11 are in aligned position with ends nearly abutted, but spaced a sufficient amount to receive mortar for a joint, the spacing between the center planes of the webs adjacent the abutted ends in respective blocks is substantially equal to that between the center planes in a single block. Accordingly, when two blocks are assembled end-to-end in a course, the adjacent open half-voids 17 combine to provide a closed void similar to the integral void 16 of a single block.

The top of each web 14 and 15 is provided with a pair of parallel notches 18 and 19 aligned with the respective notches of the webs of other blocks in the same course to provide seats for a pair of parallel horizontal reinforcing bars 21 and 22. Since commercially available lengths of such reinforcing bars often require them to be joined at their ends in any given wall, the notches 18 and 19 are deep enough to receive an end portion of one reinforcing bar 21 or 22 and the opposite end portion of a continuing bar placed on top; when concrete poured in the voids 16 or 17 sets, an adequate "splice" between lengths of the reinforcing bars is effected.

Figure 2:
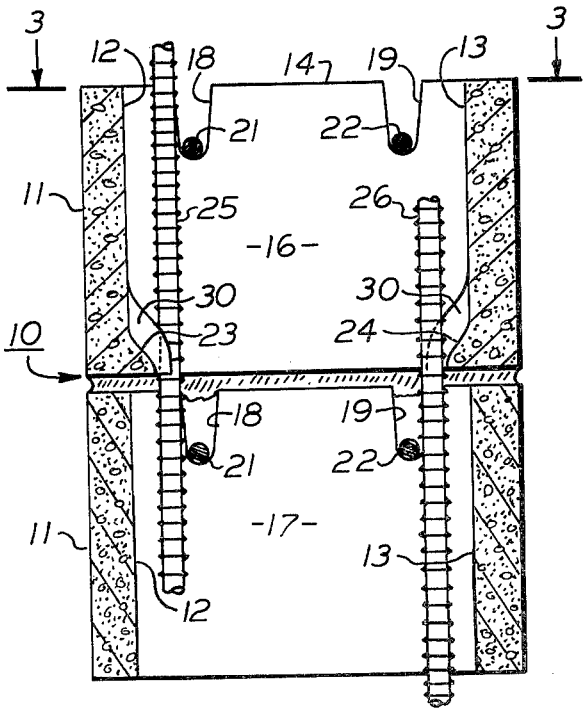
FIG. 2 is a sectional view of the masonry wall of FIG. 1 taken on the line 2—2 of FIG. 1.
Figure 3:
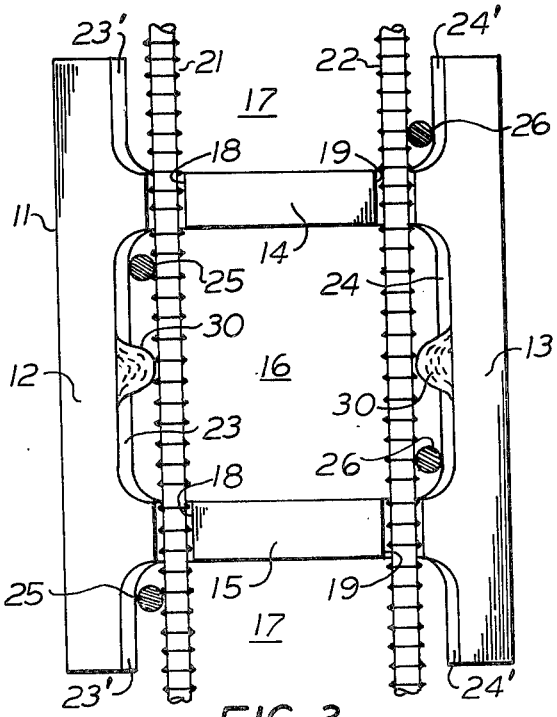
FIG. 3 is a plan view, taken from the line 3—3 of FIG. 2, but showing a modification of the uppermost block shown in FIG. 1.

Opposed inner bottom edges of the side walls 12 and 13 have inwardly projecting integrally formed lips 23 and 24. As shown in FIGS. 1 and 2, the lips 23 and 24 may be located only along the bottom edges of the portions of the side walls 12 and 13 which, with the cross-webs 14 and 15, define the integral void 16 and may be omitted from the end portions of the side walls which define the half-voids 17. Alternatively, as shown in FIG. 3, the bottom edges of the ends of the side walls 12 and 13 which define the half-voids 17 may be provided with lips 23' and 24' which extend toward the webs 14 and 15 and correspond in configuration to the similar portions of the lips 23 and 24.

Referring to the drawings, the configuration of a lip 23 or 24 is significant for the operativeness of this invention. Throughout the portions of its length against which a vertical reinforcing bar may bear, the bottom edge of a lip projects inwardly from its side wall a distance sufficiently less than the distance from its adjacent notch in a cross-web 14 or 15 to permit a horizontal reinforcing bar to be received in the notch and, with clearance, a vertical reinforcing bar to be inserted between a horizontal bar and the inner edge of the lip. From its inner edge each lip is filleted upwardly to its adjacent side wall to minimize the effect of the relative brittleness of the concrete material from which the block is molded. As the edge of a lip 23 or 24 approaches a cross-web 14 or 15, it is also filleted toward the cross-web about a radius at least greater than the radius of a vertical reinforcing bar so that a vertical bar, when inserted between a lip and a horizontal bar, is held away from a cross-web and out of the corner of a side wall and a cross-web by a distance preferably at least equal to the distance which the lip holds the vertical bar from a side wall of the block. Additionally, as shown by the preferred embodiments illustrated in the drawings, the portions of the side walls 12 and 13 which define an integral void 16 are each provided with at least one inwardly protruding knob or divider element 30 located midway between the cross-webs 14 and 15. Such a divider element 30 extends inwardly beyond a lip on the wall by a distance which is at least greater than the clearance allowed for the insertion of a vertical reinforcing bar between the inner edge of a lip and a horizontal bar seated in the adjacent notch 18 or 19 of a cross-web 14 or 15. Each divider element 30 is preferably molded or cast integrally with each lip 23 or 24 and filleted laterally into its lip as well as laterally and vertically upwardly into the side wall 12 or 13 onto which a lip is formed. Thereby a lip and divider element mutually strengthen each other but the increase in mass of such blocks attributable to the divider elements and, consequently, the cost of making them, is negligible. Similarly, such divider elements require no greater time and labor or amount of mortar in laying up a wall with such blocks than is required, for example, with blocks shown in my U.S. Pat. No. 3,222,830.

CONSTRUCTION OF WALL

In order to construct a wall with the above described blocks as modules, horizontal courses of the hollow blocks 11 are laid up, horizontal reinforcing bars 21 and/or 22 being seated in the notches 18 and/or 19 before a succeeding course is completed. The bond between vertically successive courses is preferably a plain bond so that, except at corners, one block 11 is centered on the mortared joint between the blocks in the adajcent course; an integral void 16 is thereby vertically aligned with a void comprised of the half-voids 17 joined together in the adjacent course. As shown in the drawings, a horizontal bar is usually seated in each of the thus horizontally aligned notches 18 and 19 to provide the maximum reinforcement obtainable with these bars. (If less than such reinforcement is needed and, thus, a lesser number of bars is required, the several horizontal bars are usually staggered between notches 18 and 19 in the various horizontal courses.)

After the above described mortared wall of hollow blocks has been laid up to the desired height, in each set of vertically and alternately aligned voids 16 and 17 there will be four spaces down into which a vertical reinforcing bar may be inserted. Referring to an integral void 16 as shown in plan in FIG. 3, there will be, with respect to the side wall 12, the spaces between the filleted lip 23 and horizontal rod 21 divided by an element 30 and, with respect to the side wall 13, the spaces between the filleted lip 24 and horizontal rod 22 also divided by an element 30. It is seldom necessary that vertical bars be inserted down through all such spaces, but sufficient that a pair be inserted, in which case the bars 25 and 26 are preferably staggered, as shown.

When the vertical reinforcing bars have been inserted as desired, concrete is then poured into the vertically aligned voids. As the concrete is poured, it is usually rodded, puddled or otherwise forced and compacted in place around all the bars so as to reinforce the concrete, as it sets and cures, by the bars embedded in and substantially completely surrounded thereby. As stated in the background of this invention, the pouring and forcing of the concrete around the bars may dislodge any of the bars; gravity and the depth of the notches in the cross-webs limits any displacement of the horizontal bars to a negligible degree, if any. But for the filleted lips and the intermediate divider elements 30, however, any one of the vertical bars would be free to move between an outside wall and a horizontal bar from one corner (defined by an outside wall and a cross-web) of a void 16 or 17 to the other such corner on the same side of the void. If any vertical bar should be forced into such a corner so that it contacts for any appreciable portion of its length either an outside wall or a cross-web, it will be insufficiently embedded in the concrete to exert its full reinforcing effect. Also, if a pair of vertical reinforcing bars, in any given void, are intended to be staggered (as shown in the drawings) but one is shifted into substantially transverse alignment with the other, the intended reinforcement will not be effected and the substantial mis-alignment will usually be evident (since the vertical reinforcing bars usually extend above a completed wall).

This invention has been shown and described with respect to specific embodiments thereof for purposes of illustration only, and not as limitations, and may be modified by those skilled in the art without departing from the scope of this invention as set forth in the appended claims. For example, just as the location of a divider element 30 in an integral void 16 of one block serves to limit shifting of vertical bars which extend through a void comprised of half-voids 17, in an adjacent course, the lips 23' and 24' shown in the modification in FIG. 3 will permit (assuming the divider elements 30 are retained in a void 16) the elimination of the lips 23 and 24 in a void 16. Further, the shifting of a vertical bar as concrete is settled around it may be further limited by increasing the longitudinal width of a divider element 30, by increasing the width of a lip as it is filleted into a cross-web, and/or by increasing the number of divider elements along a given side wall. Whether the limitation of the shifting of a vertical bar is increased by one or more of these variations, sufficient vertical space should remain—in a longitudinal direction—between a divider element and an adjacent cross web and—in a traverse direction—between an inward longitudinally extending projection or tip on an outer wall and a horizontal reinforcing bar held by the cross-web to permit insertion of a vertical reinforcing bar as the blocks are laid up in successive courses to bring voids into substantially vertical alignment. Consequently the invention is not limited to blocks having the conventional configuration of a single integral void defined by the outer walls and a pair of transverse cross-webs but is applicable to other configurations, such as those having a plurality of integral voids defined by more than two cross-webs or those having a single transverse cross-web so as to provide an H-shaped configuration and the voids in a given course are created by vertical mortar joints between the ends of the side walls of adjacent blocks in the course.

What is claimed is:

1. In a reinforced masonry wall constructed of primary hollow block type modules laid up in courses with mortared joints and with horizontal and vertical reinforcing bars embedded in concrete thereafter poured in the voids of said modules and wherein a primary module comprises side walls joined by transverse webs spaced from the ends of said side walls to define at least one integral void between adjacent webs and voids between adjacent ends of abutting primary modules, voids in each course being vertically aligned in stacks with voids of other courses and the webs having horizontally aligned notches for receiving the horizontal reinforcing bars, and wherein said primary modules each have a lip projecting inwardly from the interior face of at least one side wall into its respective void to permit a vertical reinforcing bar to be inserted, with clearance, in a stack of aligned voids through a plurality of courses and positioned between adjacent vertically aligned horizontal reinforcing bars and the vertically aligned lips of modules in said courses, the improvement comprising:

primary modules of said wall having an inwardly projecting divider element formed and filleted onto the interior face of at least one of the said side walls thereof between the webs that define the respective integral voids and having a greater inward projection than the sum of the inward projection of said lip and the clearance permitting said vertical bar to be inserted between a horizontal bar and an adjacent side wall, whereby the vertically aligned divider elements in a stack of voids will position a vertical reinforcing bar entirely on one side of said divider elements to limit displacement of said vertical reinforcing bar by movement in a direction parallel to said horizontal reinforcing bars as concrete is poured and settled in said voids.

2. A masonry wall as defined in claim 1 in which said lip extends to a transverse web and is filleted into said web about a radius greater than the radius of said vertical reinforcing bar whereby said divider element and said fillet prevent displacement of said vertical reinforcing bar into the corner formed by the junction of a transverse web and a side wall.

3. A masonry wall as defined in claim 2 wherein said lip and said divider element are formed integrally with each other and the inner face of a side wall bounding an integral void to effect mutual reinforcement of said lip and divider element.

4. In a primary masonry module of the hollow block type formed from concrete and with side walls joined by vertical webs spaced from the module's ends to define an integral void between adjacent webs and voids between adjacent webs of abutting modules when laid in a course, wherein the webs have horizontally aligned reinforcing bar-receiving notches and wherein a lip projects inwardly from the interior face of at least one side wall into its respective void for spacing, from said side wall, a vertical reinforcing bar insertable, with clearance, between a horizontal reinforcing bar positioned in said notches and an adjacent side wall, the improvement which comprises:

an inwardly projecting divider element formed on the interior face of at least one of said side walls of said module between and spaced from said webs and having a greater inward projection than the sum of the inward projection of said lip and the clearance permitting a vertical bar to be inserted between a horizontal bar and a lip whereby said divider element will position and retain said vertical reinforcing bar entirely on one side thereof and limit movement of said vertical bar in a direction parallel to said horizontal bar.

5. A masonry module as defined in claim 4 in which said lip is formed on and is integral with a portion of a side wall extending from substantially the end of a module to an adjacent transverse web, said lip being joined to said transverse web by an inwardly curving fillet having a radius greater than the radius of a reinforcing bar insertable between said horizontal bar and an adjacent side wall whereby movement of said vertical bar toward said transverse web is limited by said fillet.

6. A masonry module as defined in claim 4 in which said lip is formed on and is integral with a side wall bounding an integral void and said lip extends to and is joined into said transverse webs by fillets each having a radius greater than the radius of said vertical bar insertable between said horizontal bar and said side wall, whereby movement of said vertical bar toward a transverse web in a direction parallel to said horizontal bar is limited by a fillet.

7. A masonry module as defined in claim 6 in which said divider element and said lip are formed integrally with each other and said side wall, whereby said divider element and lip mutually reinforce each other.

8. A masonry module as defined in claim 7 in which each side wall bounding an integral void is formed at its lower edge with a mutually reinforcing ip and divider element formed integrally with each other and the side wall from which they project.

9. A masonry module comprised of an opposed pair of side walls, an internal transverse cross-web joining said side walls, a longitudinally extending integral projection on at least one of said side walls which projects transversely inwardly toward an opposed side wall, means to restrain, from transverse movement away from an adjacent side wall, a horizontal reinforcing bar supported by a transverse web in a direction substantially parallel to a side wall, the transverse horizontal distance between an edge of said longitudinally extending projection on said side wall and the adjacent surface of such horizontal reinforcing bar being sufficient to permit a vertical reinforcing bar to be, with clearance, inserted vertically therebetween, said inwardly and longitudinally extending projection on said side wall being filleted into said cross-web about a radius greater than the radius of said vertical reinforcing bar, a divider element integral with the interior of a side wall and extending inwardly therefrom for a distance greater than such clearance plus the inward horizontal distance from said side wall of the edge of said longitudinally extending projection, said divider element being sloped toward the side wall with which it is integral at an obtuse angle, whereby said divider element, inward projection on said outside wall, and said horizontal reinforcing bar define a limited space within which such insulated vertical reinforcing bar may be shifted longitudinally.

10. A masonry module as defined in claim 9 in which the vertical height of said divider element subject to contact with such vertical reinforcing bar is substantially less than the vertical height of the side wall with which it is integral, whereby such reinforcing bar will be completely surrounded by and embedded in concrete filling a void defined by opposed side walls, except at points of possible contact with such horizontal reinforcing bars, the innermost edge of said longitudinally and inwardly extending projection from a side wall, and said divider elements when such vertical reinforcing bar is inserted in said limited space.

11. A masonry module as defined in claim 10 in which said divider element is wider where it is integral with said side wall than at the innermost portion of its surface and its surface divergently merges into said side wall, whereby said divider element structurally resists fracture from said side wall.

12. A masonry module as defined in claim 11 in which said divider element is integral with said longitudinally inwardly extending projection on said side wall and is approximately parabaloid in configuration, whereby said element and projection mutually reinforce each other where they are integral with each other and said side wall and possible contact between said divider element and such vertical reinforcing rod inserted in said limited space is substantially a point contact.

* * * * *